US008356434B2

(12) United States Patent
Alipour

(10) Patent No.: US 8,356,434 B2
(45) Date of Patent: Jan. 22, 2013

(54) RETRACTABLE LABEL

(76) Inventor: Ehsan Alipour, San Francisco, CA (US)

( * ) Notice: Subject to any disclaimer, the term of this patent is extended or adjusted under 35 U.S.C. 154(b) by 0 days.

(21) Appl. No.: 13/227,429

(22) Filed: Sep. 7, 2011

(65) Prior Publication Data

US 2012/0118779 A1 May 17, 2012

Related U.S. Application Data

(63) Continuation of application No. 11/650,876, filed on Jan. 8, 2007, now Pat. No. 8,104,202.

(60) Provisional application No. 60/757,698, filed on Jan. 10, 2006.

(51) Int. Cl.
*G09F 3/00* (2006.01)

(52) U.S. Cl. ..... 40/310; 40/311; 40/514; 215/203

(58) Field of Classification Search ..... 40/306, 40/307, 310, 311, 312, 313, 514, 515; 215/365, 215/366, 383, 230
See application file for complete search history.

(56) References Cited

U.S. PATENT DOCUMENTS

| | | | | |
|---|---|---|---|---|
| 180,132 | A | 7/1876 | Hoard et al. | |
| 251,566 | A | 12/1881 | Fuller | |
| 883,844 | A | 4/1908 | Waterman | |
| 1,049,275 | A | 12/1912 | Scott | |
| 1,262,972 | A | 4/1918 | Olson | |
| 1,561,725 | A | 8/1923 | Kerley | |
| 1,850,369 | A | 3/1932 | Andrews | |
| 2,005,110 | A | 6/1935 | Ritzert | |
| 4,227,615 | A | 10/1980 | Flick | |
| 4,787,161 | A | 11/1988 | Feng | |
| 5,065,875 | A | 11/1991 | Balavich | |
| 5,359,797 | A * | 11/1994 | Williamson | 280/816 |
| 5,704,648 | A | 1/1998 | Brown et al. | |
| 5,866,219 | A | 2/1999 | McClure et al. | |
| 5,884,421 | A | 3/1999 | Key | |
| 5,992,073 | A | 11/1999 | Wolpa | |
| 6,301,812 | B1 | 10/2001 | Klunk | |
| 6,360,462 | B1 | 3/2002 | Mengel | |
| 6,418,283 | B1 | 7/2002 | Wegman et al. | |
| 6,680,097 | B1 | 1/2004 | Amberger et al. | |
| 6,729,369 | B2 | 5/2004 | Neas et al. | |
| 6,758,338 | B2 | 7/2004 | Lien | |
| 6,783,159 | B2 | 8/2004 | Tuttle et al. | |
| 6,845,064 | B2 | 1/2005 | Hildebrandt | |
| 7,122,157 | B2 | 10/2006 | Stevens et al. | |
| 2004/0045856 | A1 | 3/2004 | Rhoades | |
| 2004/0216775 | A1 * | 11/2004 | Kotovsky | 135/66 |
| 2009/0249665 | A1 | 10/2009 | Yang | |

* cited by examiner

*Primary Examiner* — Casandra Davis
(74) *Attorney, Agent, or Firm* — GSS Law Group

(57) ABSTRACT

A labeling system comprises a wall enclosing a space and a container for holding a retractable label, the container laterally disposed in relation to the space. The retractable label is configured to extend out of and retract into the container. In some embodiments, the wall at least partially defines a container cap. In other embodiments, the wall at least partially defines another container for holding material, such as, e.g., material of medicinal utility.

10 Claims, 4 Drawing Sheets

RETRACTABLE LABEL

REFERENCE TO RELATED APPLICATIONS

This application is a continuation of U.S. Utility Application Ser. No. 11/650,876 filed Jan. 8, 2007 now U.S. Pat. No. 8,104,202 which claims the benefit of U.S. Provisional Application No. 60/757,698, filed on Jan. 10, 2006, the specifications and drawings of which are hereby incorporated by reference in their entirety.

BACKGROUND OF THE INVENTION

1. Field of the Invention

The present invention generally relates to a label, more particularly to a retractable label.

2. Description of the Related Art

Containers may be used to hold solids, liquids and gases. Containers have countless uses, such as holding, for example, material of medicinal utility (e.g., pills), refreshments (e.g., water, soft drinks), and food items. Some containers comprise a cap for sealing the contents therein, while others, such as, e.g., a container comprising a syringe, have plungers on one end and a needle on the other for injecting a drug into a patient.

Manufacturers and distributors typically need to provide health and safety information about a container's content to consumers. For instance, a pharmacy may need to provide detailed information regarding the proper use of a drug, or a soft drink manufacturer may need to provide nutritional details. Such information is typically provided on displays affixed to the outer surface of a container. These displays are commonly referred to as labels.

As the necessity to provide more information on labels increases, labels have become more crowded, making the information printed on them difficult to read. Some manufacturers have attempted to solve this problem by resorting to smaller text sizes, which leads to further difficulty in reading and understanding the labels. This can have serious consequences in cases where the information on a label is essential to the well being of a consumer.

There have been attempts at making labels more readable. For example, U.S. Pat. No. 5,884,421 ("the '421 patent"), which is entirely incorporated herein by reference, teaches a rotatable label that allows an improvement in the presentation of information printed on a label. As another example, U.S. Pat. No. 5,866,219 ("the '219 patent"), which is entirely incorporated herein by reference, discloses a system comprising a base member and a fold out pamphlet. The base member may be attached to a container, and the pamphlet can be removed from the base member and reapplied for future use. As still another example, U.S. Pat. No. 6,360,462 ("the '462 patent"), which is entirely incorporated herein by reference, discloses a product information label system that comprises an information package, wherein the information package may be extended through a window when the container is rotated in one direction and retracted when the container is rotated in the opposite direction. This provides the advantage of concealing the information package if the information provide thereon is confidential.

BRIEF DESCRIPTION OF THE DRAWINGS

The invention will be better understood from the Detailed Description of the Preferred Embodiments and from the appended drawings, which are meant to illustrate and not to limit the invention, and wherein.

DETAILED DESCRIPTION OF THE PREFERRED EMBODIMENTS

Figure 1A:
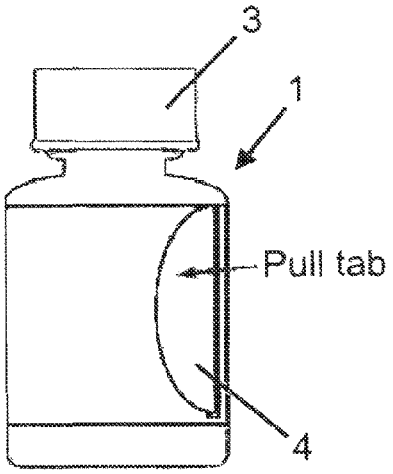
FIGS. 1A and 1B are schematic side views of a container comprising a retractable label, in accordance with a preferred embodiment of the invention.

Label systems available in the art have several limitations. For example, the base member and label combination of the '219 patent opens the possibility for the label getting misplaced and, as a consequence, unavailable when it is required. As another example, the extendable and retractable label of the '462 patent requires that the user twist an outer sleeve in relation to the container to either extend or retract the label, which poses a problem for individuals with physical ailments (e.g., arthritis or carpel tunnel syndrome) that make it difficult to carry out this operation. As still another example, a limitation of the retractable label of the '421 patent is that the amount of information printed on the label does not increase significantly in relation to a non-retractable label provided directly on a container.

Additionally, limitations of prior art label systems pose several problems. For example, in some cases extra informational material (e.g., pamphlet) is supplied with a first container in order to provide information about the first container and/or the content(s) of the first container. This information material may be affixed to a larger second container housing the first container. A problem in this case is that the informational material may get lost once the second container is opened to remove the first container. As another example, large containers—larger than what is needed to contain a substance—may be used in cases where large labels are affixed to the container to provide information about the container and/or its content(s). This is problematic because it leads to increased costs. Additionally, large containers occupy more space in a storage facility than smaller containers, which can lead to the requirement of additional storage facilities, thus leading to further increases in costs.

Accordingly, there is a need in the art for improved container labels. In particular, there is a need to present container information in a coherent fashion without limiting the content that is provided on the container label. This need presents itself in various contexts. For instance, pharmacies may need to present patients with personalized (or customized) detailed instructions for the proper usage of a particular drug.

Preferred embodiments of the present invention provide a label system wherein a label (also "retractable label" herein)

comprising information printed thereon is configured to extend away from a container and retract back to its original position. Preferred embodiments provide several advantages over prior art label systems. As an example, moving at least some of the information from a conventional, stick-on label to a retractable label permits the usage of smaller and/or fewer labels, enabling the contents of the bottle to be more visible. As another example, that a user has to retract the label to access its information may increase the likelihood that the information will be read. As yet another example, in some embodiments, the label can be retracted without much effort on part of the user. In some cases, a tab may be provided with the label to ensure that the instructions on the label will be read. The tab may have a textual and/or graphical warning(s) included thereon, such as, e.g., "Read Me" in red font.

It will be appreciated that "container" (or "compartment") as used herein comprises anything (e.g., carton, box, crate, or canister) that contains or can contain a solid, liquid, gas, or combinations thereof. It will be further appreciated that a container can have any geometric shape and dimension. As an example, a container can be a cylindrical canister. As another, a container can be a boxlike carton. As still another example, a container may be a crate with a length equal to its width, and a height not equal to its length.

It will be appreciated that containers of preferred embodiments may have one or more openings. An opening of preferred embodiments can have any shape and dimension. These openings include holes (e.g., rectangular holes, circular holes, triangular holes) and slits (e.g., elongated slits). In some embodiments, the holes permit the unimpeded extension and retraction of a label to and from a container housing the label.

One or more walls may define a container. The one or more walls define a container space in which material is housed (or stored). Additionally, a wall defining one container may at least partially define another container. As an example, a wall partially defining a first container may have a thicker, hollow portion at the periphery of the first container that at least partially defines a second container, the second container being adjacent the first container. The first container may be larger than the second container, of equal size as the second container, or smaller than the second container. In some embodiments, the wall is thicker in one area than another.

It will be appreciated that "label" (or "retractable label") as used herein comprises any object capable of displaying information. As an example, a label may be a piece of paper, fabric, plastic, or metal displaying information about a container and/or the contents of the container. As another example, a label may be an electronic display, the electronic display configured to display information about a container and/or the contents of a container. A label may be flexible or rigid.

Information may be displayed on one or more sides of the label. As an example, a plastic label may have information printed on both its front side and, back side. As another example, a paper label may have information printed on one side, with the opposite side not displaying any information.

In preferred embodiments, a label (also "retractable label" herein) is configured to extend away from a container and retract back to the container. In some embodiments, the label extends away from the container upon the application of an external force, and retracts back toward the container upon the removal of the external force. As an example, the label may be pulled out of its original position and returned (i.e., retracted) back to its original position when it is released. As another example, a motor (e.g., electric motor) within a container having the label may extend and retract the label. Further, retractable labels of preferred embodiments can accommodate personalized (or customized) information. This information can be provided by any means possible, such as, e.g., using a printer or a pen. Additionally, retractable labels of preferred embodiments can include any information, such as, e.g., pharmaceutical information, nutritional information, promotional information, etc.

In preferred embodiments, a container is laterally disposed in relation to a space enclosed by one or more walls (collectively "wall" herein). The container comprises a retractable label. In some embodiments, the wall at least partially defines the container. In one embodiment, the wall defines a container cap. In another embodiment, the space is included in an other container for holding material. In some embodiments, the container is defined by an other wall, the other wall attached to the wall enclosing the space.

In preferred embodiments, a first container is adjacent a second container, and the second container comprises a retractable label. The first container includes a first space and the second container includes a second space. In one embodiment, the first space is of greater volume than the second space. In another embodiment, the first space is of equal volume than the second space. In yet another embodiment, the first space is of lesser volume than the second space. In preferred embodiments, the second container is laterally disposed in relation to the first space. In some embodiments, the second container is formed from a wall that at least partially defines the first container. In other embodiments, the second container is formed from a wall that is separate from the wall that at least partially defines the first container.

In preferred embodiments, the label extends out of and retracts into the second container through an opening in a wall that at least partially defines the second container. In a preferred embodiment, the opening is a slit, such as, e.g., an elongated slit. In preferred embodiments, the wall that at least partially defines the second container is a portion of a wall that at least partially defines the first container.

In other embodiments, a container cap includes a retractable label housed (or stored) in container formed from a wall that at least partially defines the cap. The wall can have any predefined thickness. The cap includes a first space and the container includes a second space. The retractable label is within the second space. The container is preferably laterally disposed in relation to the first space. In some embodiments, the container is defined by a wall that is separate from the wall defining the cap.

Reference will now be made to the Figures, wherein like numerals refer to like parts throughout. It will be appreciated that these Figures are not necessarily drawn to scale. Furthermore, while the description below specifies objects of particular shapes, dimensions and dispositions, the skilled artisan will readily appreciate that other combinations of shapes, dimensions and dispositions can be employed.

Figure 1B:
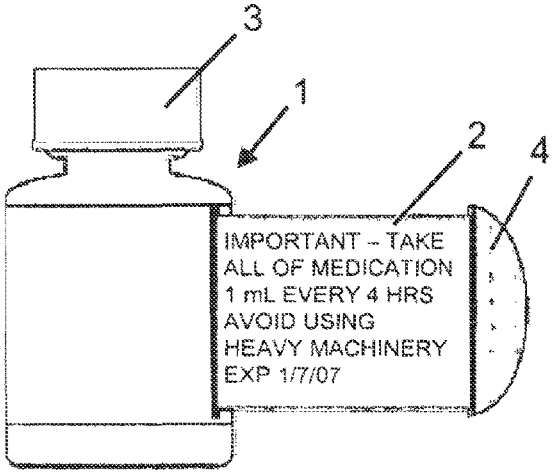

With reference to FIGS. 1A and 1B, in a preferred embodiment, a first container 1 comprises a retractable label 2 ("information sheet", as illustrated) and a cap 3. The cap 3 seals an opening of the first container 1. The first container 1 may be configured to hold any substance, such as, e.g., a substance of medicinal utility, in which case the first container 1 may be a medicine bottle. The label 2 of FIG. 1A is in a retracted position, wherein the portion of the label 2 including information (e.g., textual information) is not visible to an external viewer. The label 2 of FIG. 1B is in an extended position, wherein the information is visible to the viewer. The label 2, as illustrated, includes a tab 4 that enables a user to extend the label 2 away from the first container 1 and retract it toward the first container 1 when the tab 4 is released. This advantageously provides a user the ability to expose information in a single step, which is in contrast to prior art label systems that require two or more steps. In some embodiments, the label 2 does not contain a tab 4. In the illustrated embodiment, the label 2 includes textual information. It will be appreciated, however, that the label 2 may include graphical information in addition to (or in place of) the textual information.

Figure 1C:
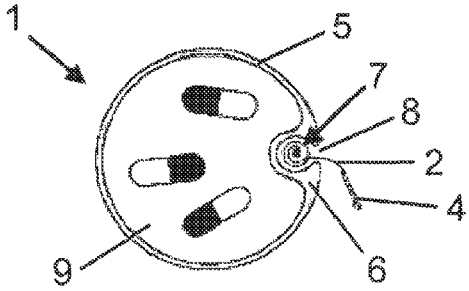
FIG. 1C is a schematic, cross-sectional top-down view of FIG. 1A, in accordance with a preferred embodiment of the invention.

FIG. 1C is a cross sectional top-down view of the first container 1. In the illustrated embodiment, a circumferential wall 5 of the first container 1 is thicker in some areas than others, with the circumferential wall 5 defining at least a portion of the first container 1. Portions of the circumferential wall 5 define a second container 7, the second container 7 being disposed at the periphery of the first container 1 (i.e., the second container 7 is at the periphery of a space 9 enclosed by the circumferential wall 5 of the first container 1). With reference to FIG. 1C, the container 7 is at the periphery of the space 9. In preferred embodiments, the container 7 is laterally disposed in relation to the space 9. In preferred embodiments, the container 7 is at the periphery In the illustrated embodiment, portions of the wall 5 that define the second container 7 are not of uniform thickness, i.e., thicker portions 6 of the circumferential wall 5 partially define the second container 7. However, it will be appreciated that portions of the wall 5 that define the second container 7 can have uniform thicknesses.

The second container 7 houses (or stores) the label 2. In the illustrated embodiment 1A and 1C), the label 2 is wound around itself in the retracted position. However, it will be appreciated that the label 2 need not be wound around itself in the retracted position.

With continued reference to FIG. 1C, the first container 1 is separated from the second container 7—the label 2 cannot come in contact with any material in the first container 1. In other embodiments (not shown), the first container 1 and second container 7 are in communication with one another through an opening formed in a portion of the wall 5 disposed between the first container I and the second container 7. In some embodiments, this provides the capability of storing at least a portion of the label 2 in the first container 1. In other embodiments, this provides a means of storing a retracting mechanism (e.g., spring, rubber band, motor) in the first container 1 and attaching it to the label 2 through the opening.

With reference to FIGS. 1B and 1C, the second container 7 is cylindrical and oriented vertically (i.e., along an axis that is perpendicular to a top surface of the cap 3) with respect to the first container 1. Preferably, the second container 7 is disposed at the periphery of the first container 1, more preferably, the second container 7 is laterally disposed in relation to the first container 1. In the illustrated embodiment, the second container 7 is smaller than the first container 1. It will be appreciated, however, that the second container 7 may be of the same size or larger than the first container 1.

With reference to FIG. 1C, the label 2 extends out of the second container 7 (or away from the first container 1) and retracts back to the second container 7 (or toward the first container 1) through an opening 8 in the second container 7. In the illustrated embodiment, the opening 8 is defined by the thicker portions 6 of the circumferential wall 5.

In preferred embodiments, the opening 8 is of any shape, size and dimension. In one embodiment, the opening 8 is a slit that runs parallel (i.e., along an axis that is perpendicular to the top surface of the cap 3) to the second container 7. In some embodiments, the opening 8 is sized so as to permit the label 2 to extend and retract unimpeded. In one embodiment, the opening is a slit with a width that is smaller than a width of the label.

It will be appreciated that the second container 7 may be of any shape, size and orientation. As an example, the second container 7 may be box like. As another example, the second container 7 may be cylindrical but oriented horizontally (i.e., along an axis that is parallel to the top surface of the cap 3) with respect to the first container 1.

In some embodiments (not shown), the second container 7 may include a wall that is separate from the wall 5 defining the first container 1, and the first container 1 and second container 7 may be attached to one another using, e.g., a glue, such as an epoxy resin.

In a preferred embodiment, a user can extend the label 2 out of the second container 7 by pulling on the tab 4. When the user releases the tab 4, the label is retracted back to the second container 7. In some embodiments, the label 2 is retracted by a spring (e.g., spring loaded mechanism) or an elastic member (e.g., rubber band) disposed in the second container 7, at a location external to the second container 7, or at a location shared by both the first container 1 and second container 7. In other embodiments, the label 2 is extended and retracted by means of a motorized mechanism (also "motor" herein). In one embodiment, the motor is disposed in the second container 7. In another embodiment, the motor is not disposed in the second container 7. The motor extends the label 2 without the user having to exert any pulling motion. Additionally, the motor is configured to retract the label 2.

Figure 2A:
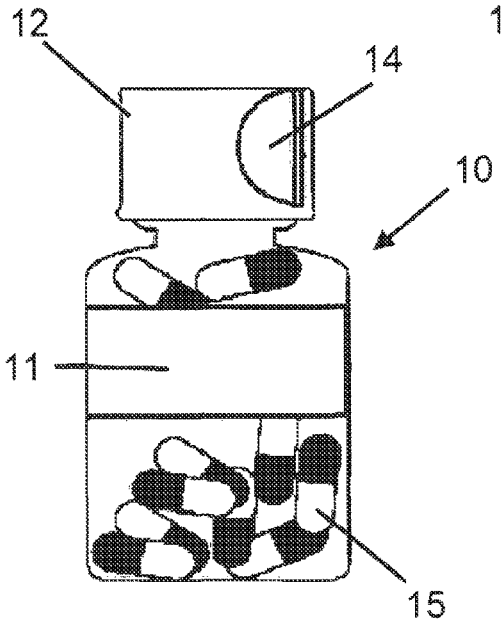
FIGS. 2A and 2B are schematic side views of a container and a cap, the cap comprising a retractable label, in accordance with a preferred embodiment of the invention.
Figure 2B:
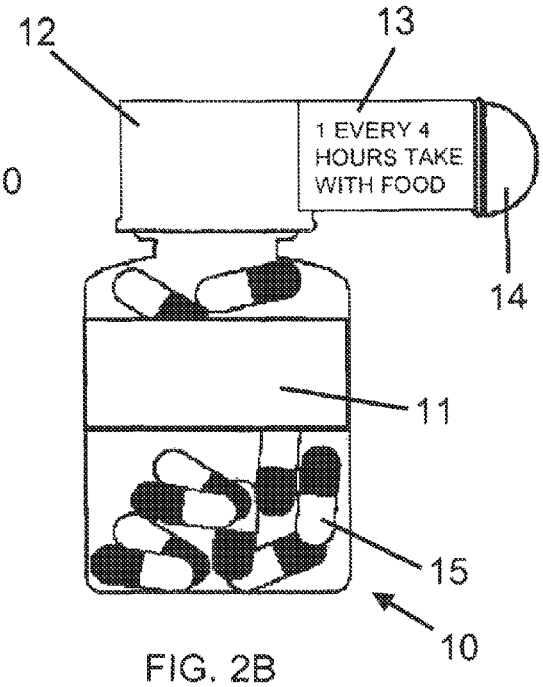
Figure 2C:
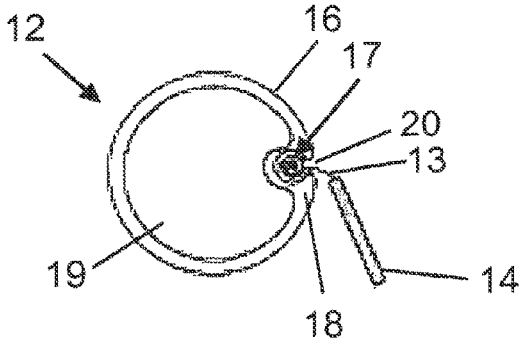
FIG. 2C is a schematic, cross-sectional top-down view of FIG. 2C, in accordance with a preferred embodiment of the invention.

With reference to FIG. 2A-2C, a label system comprising a cap having a retractable label is shown. FIGS. 2A and 2B show a container 10 having a conventional label 11 (e.g., non-retractable label that is attached to an outer surface of the container 10) and a cap 12 comprising a retractable label 13. The retractable label 13 includes a tab 14 that can enable a user to extend the label 13 away from the cap 12 and retract it back toward the cap 12 when released. While the container 10 comprises a conventional label 11, it will be appreciated that the label 11 may be a retractable label, such as the retractable label discussed in the context of FIGS. 1A-1C.

In the illustrated embodiment of FIGS. 2A and 2B, the container 10 is a cylindrical bottle containing material 15 of medicinal utility (e.g., aspirin). However, it will be appreciated that the container 10 may be of any shape and dimension, and may be configured to contain any substance (e.g., food, volatile gas, liquid, etc).

FIG. 2C is a cross sectional, top-down view of the cap 12 of FIG. 2A with the label 13 in a retracted position. In the illustrated embodiment, the cap 12 is defined at least in part by a circumferential wall 16 that is thicker in some areas than others. Portions of the circumferential wall 16 define a container 17. In the illustrated embodiment, portions of the circumferential wall 16 that define the cap 12 are not of uniform thickness, i.e., thicker portions 18 of the circumferential wall 16 partially define the container 17. However, it will be appreciated that portions of the circumferential wall 16 that define the container 17 can have uniform thicknesses. The container 17 houses (or contains) the label 13 within a space of the container 17. In the illustrated embodiment, the label 13 includes textual information. However, it will be appreciated that the label 13 may include graphical information in addition to (or in place of) textual information.

With continued reference to FIG. 2C, the circumferential wall 16 encloses a space 19, and the label 13 is not permitted to come in contact with the space 19. In other embodiments (not shown), the space 19 and container 17 are in fluid communication through a hole formed in a portion of the wall 16 disposed between the space 19 and the container 17. In such a case, the label 13 may enter the space 19 through the hole.

With reference to FIGS. 2B and 2C, the container 17 is cylindrical in shape and oriented vertically (i.e., along an axis that is perpendicular to a top surface of the cap 12) with respect to the cap 12. The container 17 comprising the label 13 is preferably laterally disposed in relation to the space 19 of the cap 12.

In some embodiments (not shown), the container 17 may be defined by a wall that is separate from the wall 16 enclosing the space 19, and the container 17 may be attached to the wall 16 using, e.g., a glue, such as an epoxy resin.

While the space within the container 17, as illustrated, is smaller than the space 19, it will be appreciated that the space within the container 17 may be of the same size or larger than the space 19.

With reference to FIG. 2C, the label 13 extends out of the container 17 (i.e., away from the cap 12) and retracts back to the container 17 (i.e., toward the cap 12) through an opening 20 within a portion of the circumferential wall 16 that defines the container 17. In the illustrated embodiment, the opening 20 is at least partially defined by the thicker portions 18 of the circumferential wall 16. In preferred embodiments, the opening 20 is of any shape, size and dimension. In one embodiment, the opening 20 is a slit that runs parallel to the container 17. The opening 20 may be sized so as to permit the label 13 to extend and retract unimpeded. In one embodiment, the opening 20 is a slit having a width that is smaller than a width of the label 13.

It will be appreciated that the container 17 may be of any shape, size and orientation. As an example, the container 17 may be box-like. As another example, the container 17 may be cylindrical but oriented parallel to the top surface of the cap 12. In such a case, the container 17 may be curved around the circumference of the cap 12.

In the illustrated embodiment of FIG. 2C, the label 13 is housed (or contained) within the container 17 by, e.g., winding it around itself. However, it will be appreciated that the label 13 need not be wound around itself in the container 17.

With reference to FIGS. 2A-2C, in a preferred embodiment, a user can extend the label 13 out of the 17 by pulling on the tab 14. When the user releases the tab 14, the label is retracted back to the container 17. In some embodiments, the label 13 is retracted by, e.g., a spring-loaded mechanism or an elastic member. In other embodiments, the label 13 is extended and retracted by means of a motor (not shown) that can be stored in the container 17 or at a location external to the container 17.

With reference to FIGS. 3A-3D, in a preferred embodiment, a syringe 30 having a retractable label 31 is shown. The syringe comprises a needle 32 on one end and a plunger 33 on the other. In the illustrated embodiment, the retractable label 31 comprises a tab 34 to enable a user to extend the label and access the information provided thereon. In other embodiments, the label 31 does not include a tab. The syringe 30 can be used for drawing in a quantity of fluid (e.g., blood) or for dispensing fluid (e.g., vaccine). The syringe can have multiples uses, such as, e.g., dispensing epinephrine, in which case the syringe can be an EpiPen.

Figure 3A:
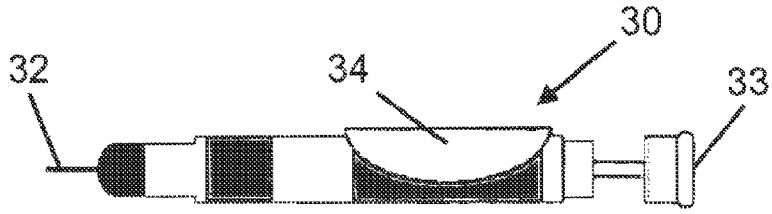
FIGS. 3A and 3B are schematic side views of a syringe comprising a retractable label, in accordance with a preferred embodiment of the invention.
Figure 3B:
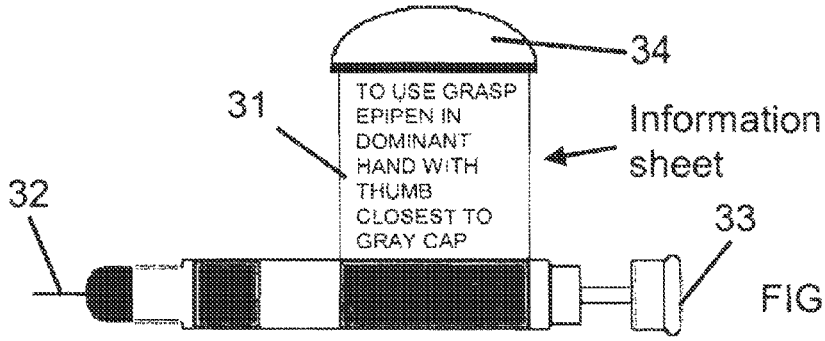
Figure 3C:
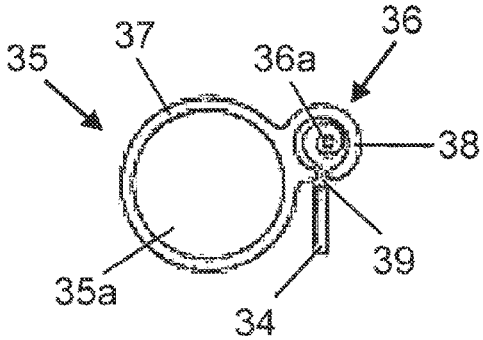
FIGS. 3C and 3D are schematic, cross-sectional side views of FIG. 3A, in accordance with a preferred embodiment of the invention.

With reference to FIG. 3C, in a cross sectional top-down view of the syringe of FIG. 3A, the syringe 30 comprises a first compartment (or container) 35 and a second compartment (or container) 36. The first compartment 35 includes a space 35*a* that is circumvented by a first wall 37. The second compartment 36 is disposed at the periphery of the first compartment 35. In preferred embodiments, the second compartment 35 is laterally disposed in relation to the first compartment 35. The second compartment 36 includes a space 36*a* that is circumvented by a second wall 38. In the illustrated embodiment, the first wall 37 is a part of the second wall 38, and the first compartment 35 is in contact with the second compartment 36. In other embodiments, the second wall 38 is not part of the first wall 37. In such a case, the second compartment 36 may be formed separately and attached to the first wall 37 (hence the first compartment 35) using, e.g., a glue, such as an epoxy resin.

With reference to FIG. 3C, the label 31 is contained in the second compartment 36. The label exits the second compartment 36 through a hole 39 in the second wall 38. In one embodiment, the hole is a slit, such as, e.g., an elongated slit. The label 31 of the illustrated embodiment is housed in the second compartment by wrapping it around itself.

Figure 3D:
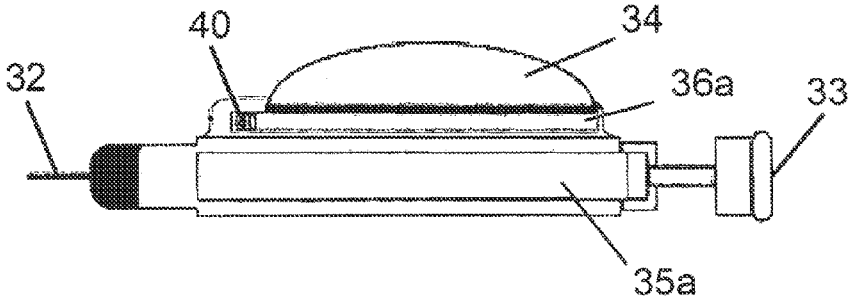

With reference to FIG. 3D, a spring 40 disposed in the second compartment 36 and in contact with the label 31 is configured to retract the label 31 into the second compartment 36. In another embodiment, the spring 40 is not disposed in the second compartment 36; it is disposed at a location external to the second compartment 36. In yet another embodiment, the spring 40 is at least partially disposed in the second compartment 36. In other embodiments, the label is retracted by an elastic member (e.g., rubber band) or a motor that is at least partially disposed in the second compartment 36 or at a location external to the second compartment 36.

With continued reference to FIG. 3C, the first wall 37 and second wall 38 may have equal thicknesses or disparate thicknesses. In one embodiment, the thickness of the first wall 37 is greater than that of a typical syringe, making the syringe 30 easier to grip.

Figure 4A:
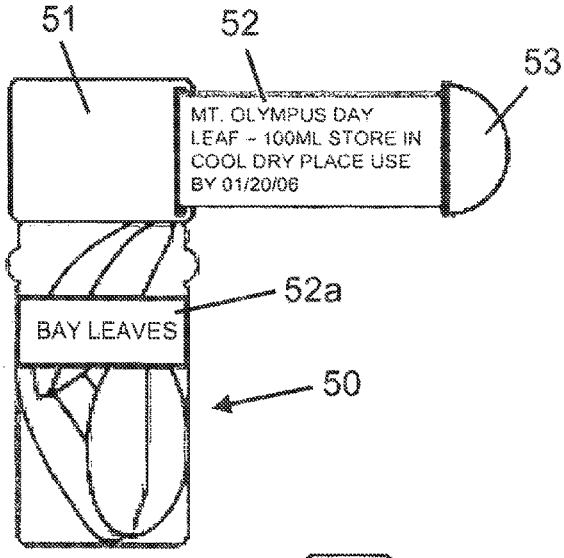
FIG. 4A is a schematic side view of a jar having a cap with a retractable label, in accordance with a preferred embodiment of the invention.
Figure 4B:
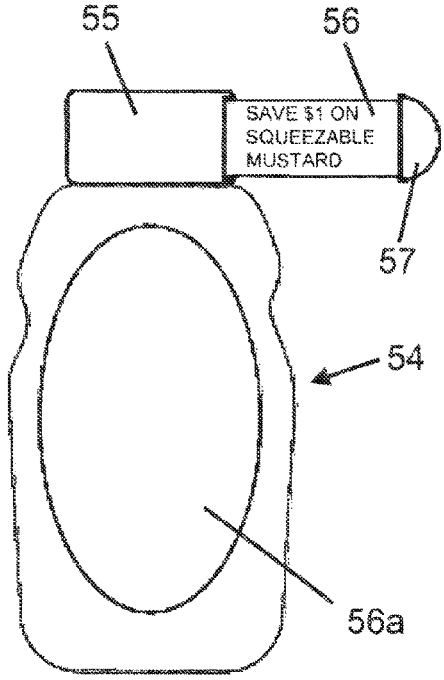
FIG. 4B is a schematic side view of a product container having a cap with a retractable label, in accordance with a preferred embodiment of the invention.
Figure 4C:
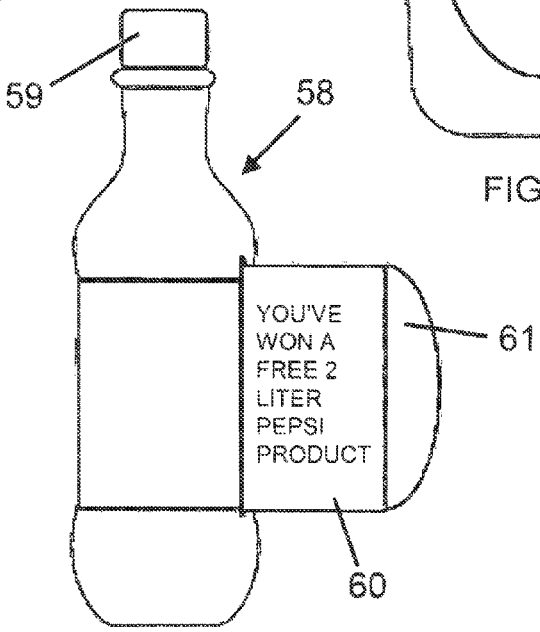
FIG. 4C is a ,schematic side view of a product container having a retractable label, in accordance with a preferred embodiment of the invention.

FIGS. 4A-4C show several applications of preferred embodiments. With reference to FIG. 4A, a jar 50 (e.g., spice jar) comprises a cap 51 with a retractable label 52 having a tab 53. The retractable label 52 has textual information provided thereon. Additionally, the jar 50 comprises a conventional stick-on (i.e., non-retractable) label 5*a*. With reference to FIG. 4B, a product container 54 (e.g., beverage container) includes a cap 55 having a retractable label 56, the retractable label 56 comprising a tab 57. The retractable label 56 may include a coupon. Additionally, the retractable label 56 may be removable from the cap 55. The retractable label 56 has textual information provided thereon. The container 54 further comprises a stick-on label 56*a*. With reference to FIG. 4C, a product container 58 comprises a cap 59 and a retractable label 60, the retractable label 60 including a tab 61. The retractable label 60 has textual information provided thereon. The product container of the illustrated embodiment of FIG. 4C may be, e.g., a beverage container, a container for holding liquid medicine, or the like. The retractable label 60 may include promotional material, or any material the distributor or manufacturer wishes to include with the retractable label 60.

It will be appreciated that the retractable labels described above may be removable (or detachable) from the container housing the retractable label. While the retractable labels of preferred embodiments have been illustrated as being disposed in a container that is within the confines of a cap or an other container, wherein the other container is configured to hold, e.g., a drug, it will be appreciated that the container comprising the retractable label need not be disposed within the confines of the cap or the other container. As an example, the container comprising the retractable label may be substantially external to the cap or the other container. As another example, the container comprising the retractable label may be partially disposed within the confines of the cap or the other container. Additionally, in some embodiments, a container comprising a cap can have a retractable label associated with the container and another retractable label associated with the cap (i.e., the container and cap combination includes two retractable labels). In other embodiments, a container and cap combination can include more than two retractable labels, such as, e.g., three, four or five retractable labels.

Thus, according to one aspect, a labeling system is provided. The labeling system comprises a wall enclosing a space and a container for holding a label, the container laterally disposed in relation to the space. The label is configured to extend out of and retract into the container.

According to another aspect, a container label system is provided. The container label system comprises a first container for holding material and a second container for holding a label, the second container laterally disposed in relation to the first container. The label is configured to extend out of and retract into the second container through an opening in the second container.

According to yet another aspect, a system for labeling a container is provided. The system comprises a first container for holding material, a cap disposed over the first container and a second container for holding a label, the second container adjacent a space of one of the first container and the cap. The label is configured to extend out of and retract into the second container.

It will be appreciated by those skilled in the art that various other omissions, additions and modifications may be made to the methods and structures described above without departing from the scope of the invention. All such modifications and changes are intended to fall within the scope of the invention, as defined by the appended claims.

I claim:

1. A labeling system, comprising:

a first container comprising a first wall enclosing a space; and a second container laterally disposed in relation to said first container, comprising:

a second wall formed as a part of said first wall; and a retractable label, said second container formed with an aperture through which said retractable label passes laterally, said retractable label laterally extendable outward from said second container, and said retractable label is retractable into said second container.

2. The labeling system of claim 1, wherein the wall at least partially defines a container cap.

3. The labeling system of claim 1, wherein the wall at least partially defines a container for holding material.

4. The labeling system of claim 1, wherein the label comprises information printed thereon.

5. The labeling system of claim 4, wherein the information is printed on both sides of the label.

6. The labeling system of claim 1, wherein the label is formed of a flexible material.

7. The labeling system of claim 1, wherein said second container further comprises a retracting mechanism for retracting said retractable label.

8. A labeling system, comprising:

a first container for holding material;

a cap disposed over said first container, comprising:

a first wall enclosing a space; and a second container laterally disposed in relation to said first wall, comprising:

a second wall formed as a part of said first wall; and a retractable label, said second container formed with an aperture through which said retractable label passes laterally, said retractable label laterally extendable outward from said second container, and said retractable label is retractable into said second container.

9. The container label system of claim 8, further comprising a third container for holding an other label, wherein the third container is adjacent a space of the other of the first container and the cap.

10. The labeling system of claim 8, wherein said second container further comprises a retracting mechanism for retracting said retractable label.

* * * * *